US010893736B2

(12) United States Patent
Yamasaki

(10) Patent No.: US 10,893,736 B2
(45) Date of Patent: Jan. 19, 2021

(54) DRAWING APPARATUS AND DRAWING METHOD

(71) Applicant: CASIO COMPUTER CO., LTD., Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/462,387

(22) PCT Filed: Aug. 10, 2018

(86) PCT No.: PCT/JP2018/030026
§ 371 (c)(1),
(2) Date: May 20, 2019

(87) PCT Pub. No.: WO2019/054110
PCT Pub. Date: Mar. 21, 2019

(65) Prior Publication Data

US 2019/0313764 A1 Oct. 17, 2019

(30) Foreign Application Priority Data

Sep. 13, 2017 (JP) ..... 2017-175298

(51) Int. Cl.
*A45D 29/00* (2006.01)
*B41J 2/21* (2006.01)
*B41J 3/407* (2006.01)

(52) U.S. Cl.
CPC ..... *A45D 29/00* (2013.01); *B41J 2/2103* (2013.01); *B41J 3/4073* (2013.01); *A45D 2029/005* (2013.01)

(58) Field of Classification Search
CPC ..... B41J 3/4073; B41J 3/407; B41J 2/2103; A45D 2029/005; A45D 29/00
See application file for complete search history.

(56) References Cited

U.S. PATENT DOCUMENTS 6,286,517 B1 9/2001 Weber et al.
2017/0329309 A1 11/2017 Valade

FOREIGN PATENT DOCUMENTS

JP 2003534083 A 11/2003
JP 2015047473 A 3/2015
WO 2016128282 A1 8/2016

OTHER PUBLICATIONS

International Search Report (ISR) and Written Opinion dated Sep. 25, 2018 issued in International Application No. PCT/JP2018/030026.

(Continued)

*Primary Examiner* — Jannelle M Lebron
(74) *Attorney, Agent, or Firm* — Holtz, Holtz & Volek PC

(57) ABSTRACT

A drawing apparatus includes a drawing head and a control device. If a drawing target surface has a first region acclivitous and declivitous respectively in first and second directions different from one another, the drawing head draws first pixels to be drawn on the first region while performing first and second scans in which the drawing head moves respectively in the first and second directions. The control device controls a ratio of a drawing amount of a first scan drawing pixel to be drawn in a line of the first region during the first scan to a drawing amount required for pixels in the line among the first pixels to be higher than a ratio of a drawing amount of a second scan drawing pixel to be drawn in the line during the second scan to the drawing amount required for the pixels in the line.

11 Claims, 10 Drawing Sheets

(56) References Cited

OTHER PUBLICATIONS

International Preliminary Report on Patentability (IPRP) dated Mar. 17, 2020 issued in International Application No. PCT/JP2018/030026.

[Fig. 1A]
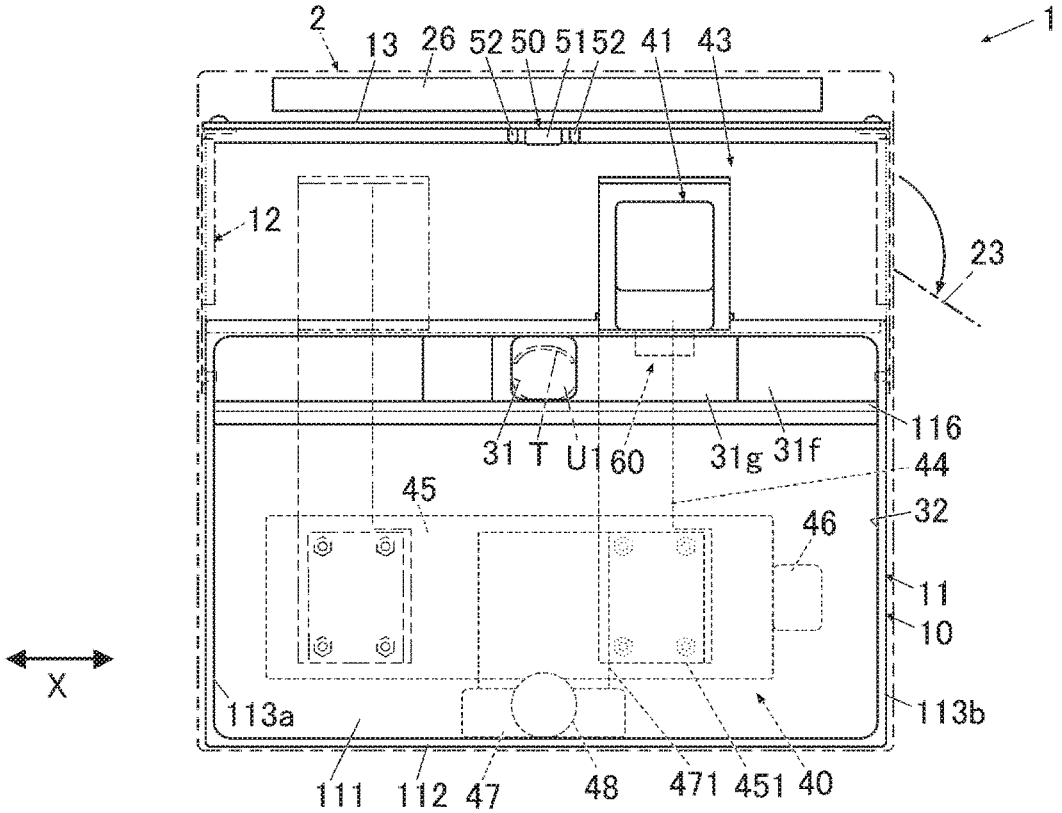
[Fig. 1B]
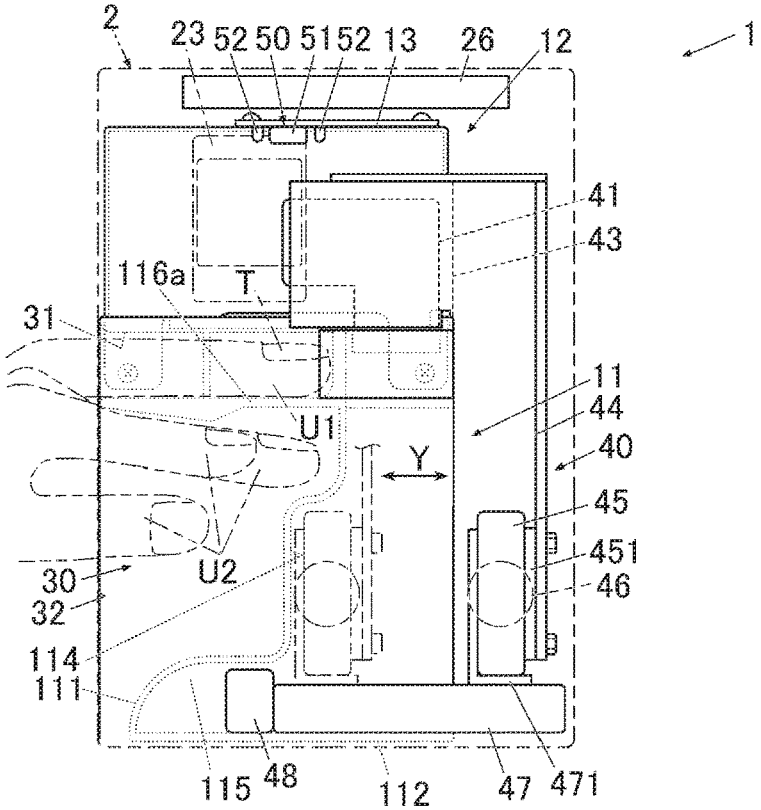

[Fig. 2]
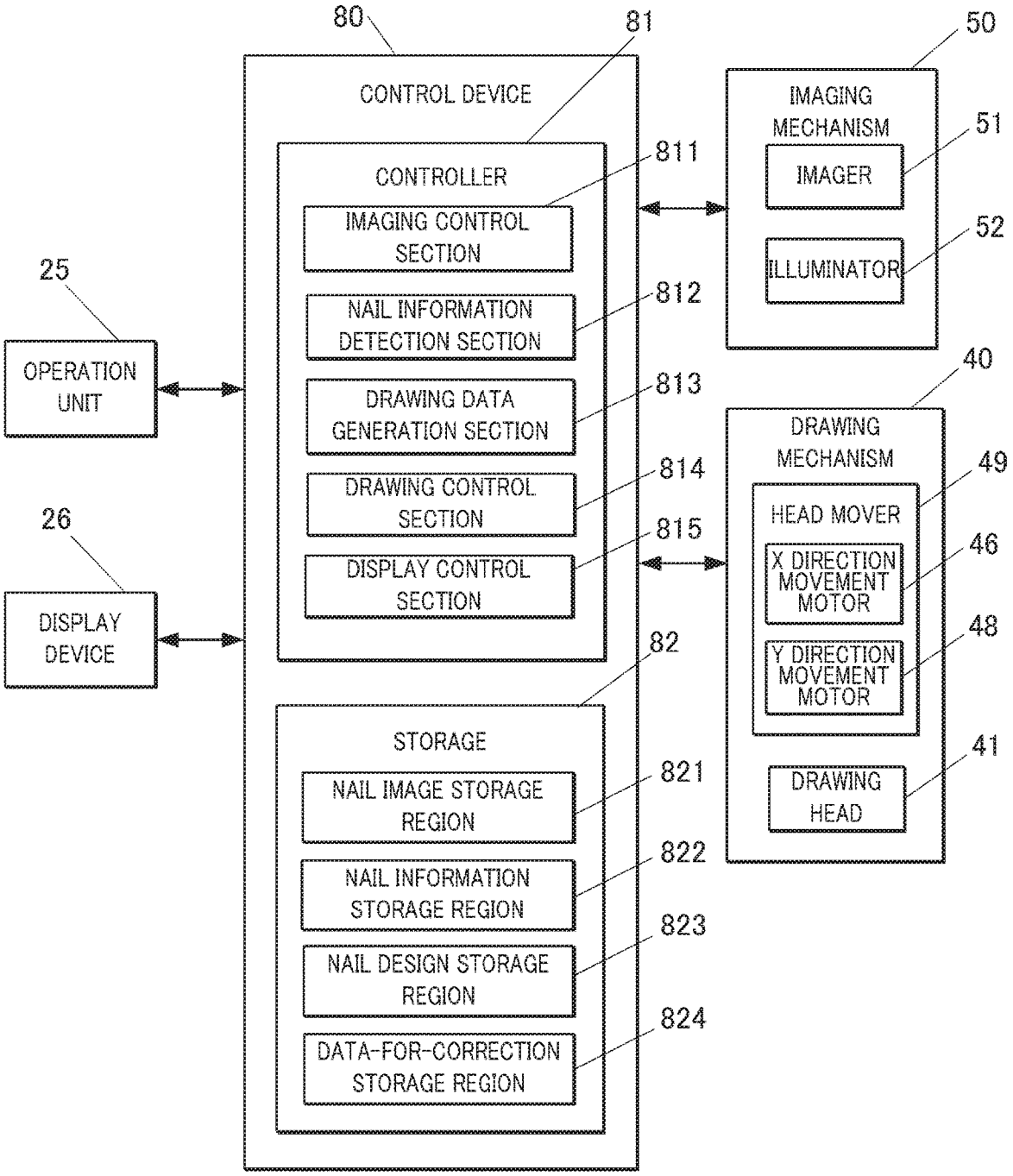

[Fig. 3]
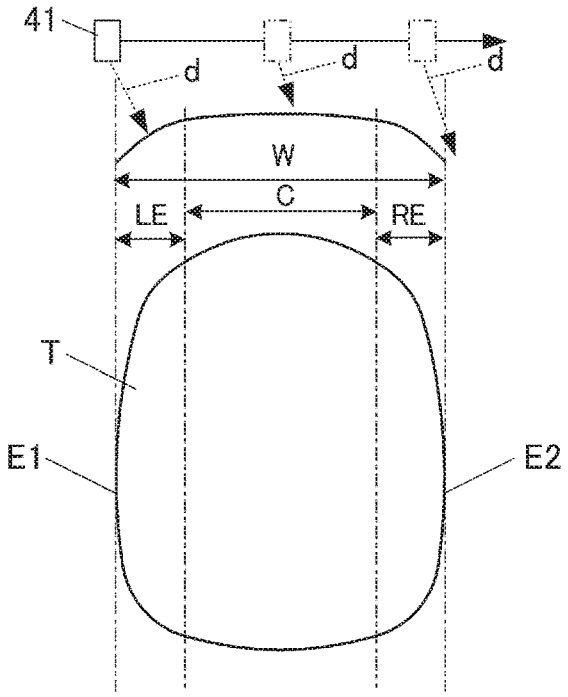
[Fig. 4A]
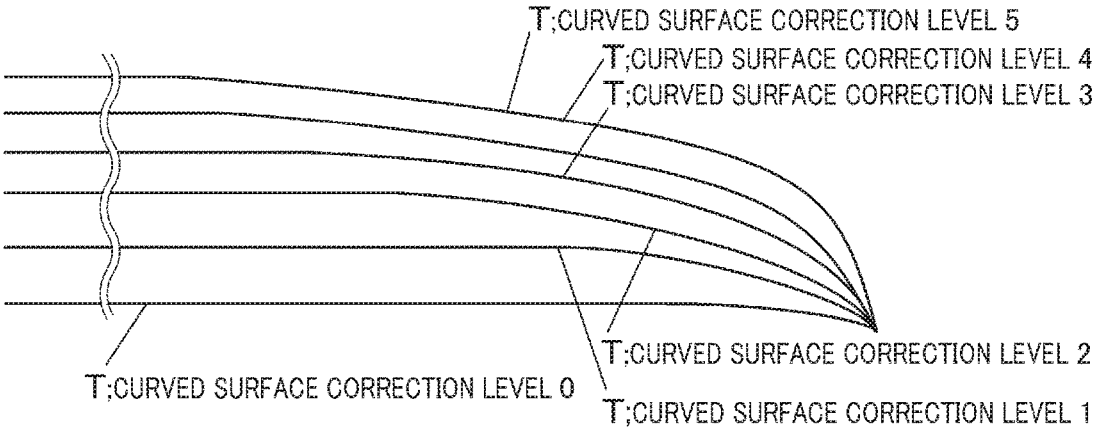
[Fig. 4B]
| CURVED SURFACE CORRECTION LEVEL | CORRECTION AREA (%) |
|---|---|
| 0 | 0 |
| 1 | 5 |
| 2 | 10 |
| 3 | 15 |
| 4 | 20 |
| 5 | 25 |

[Fig. 5]
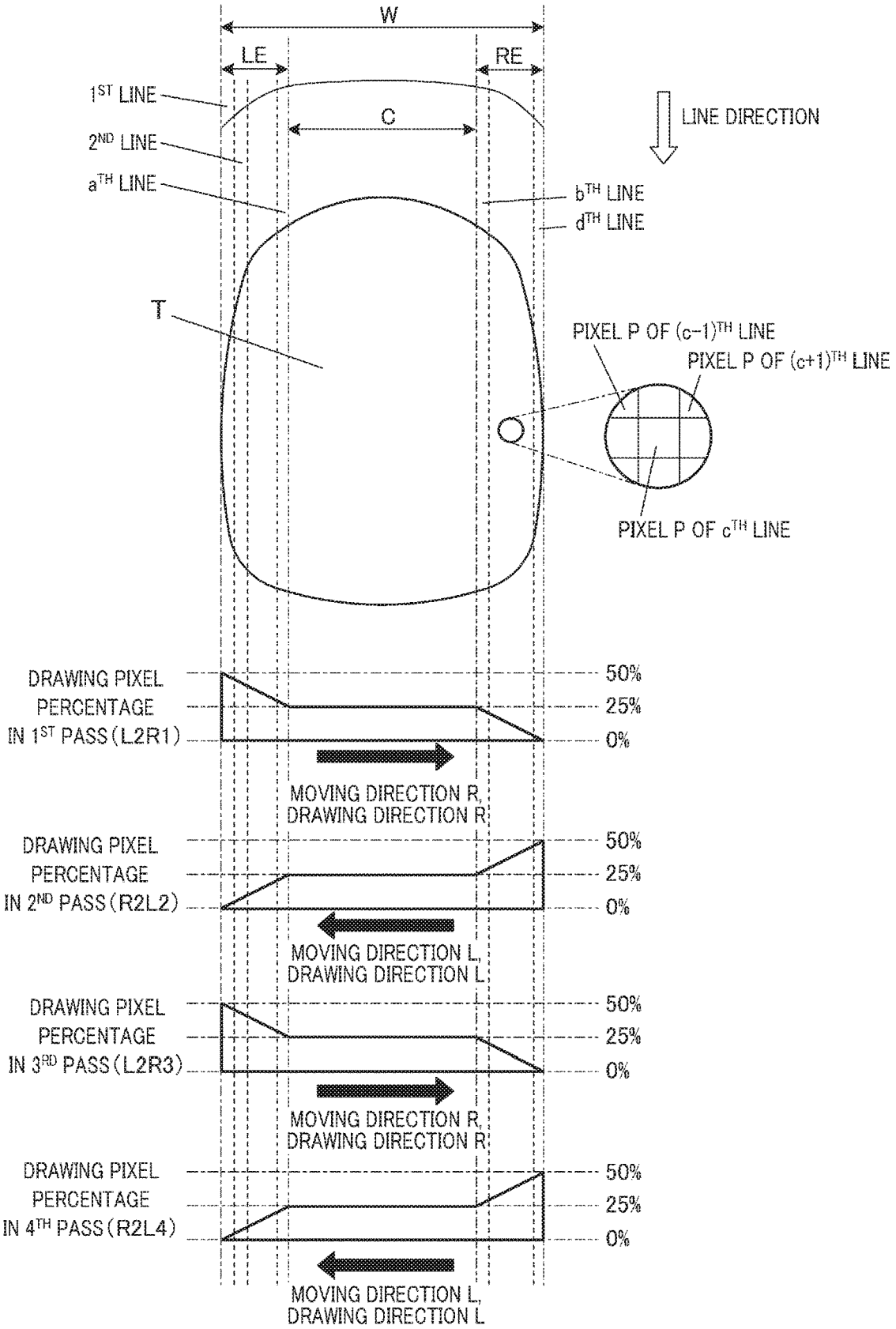

[Fig. 6]
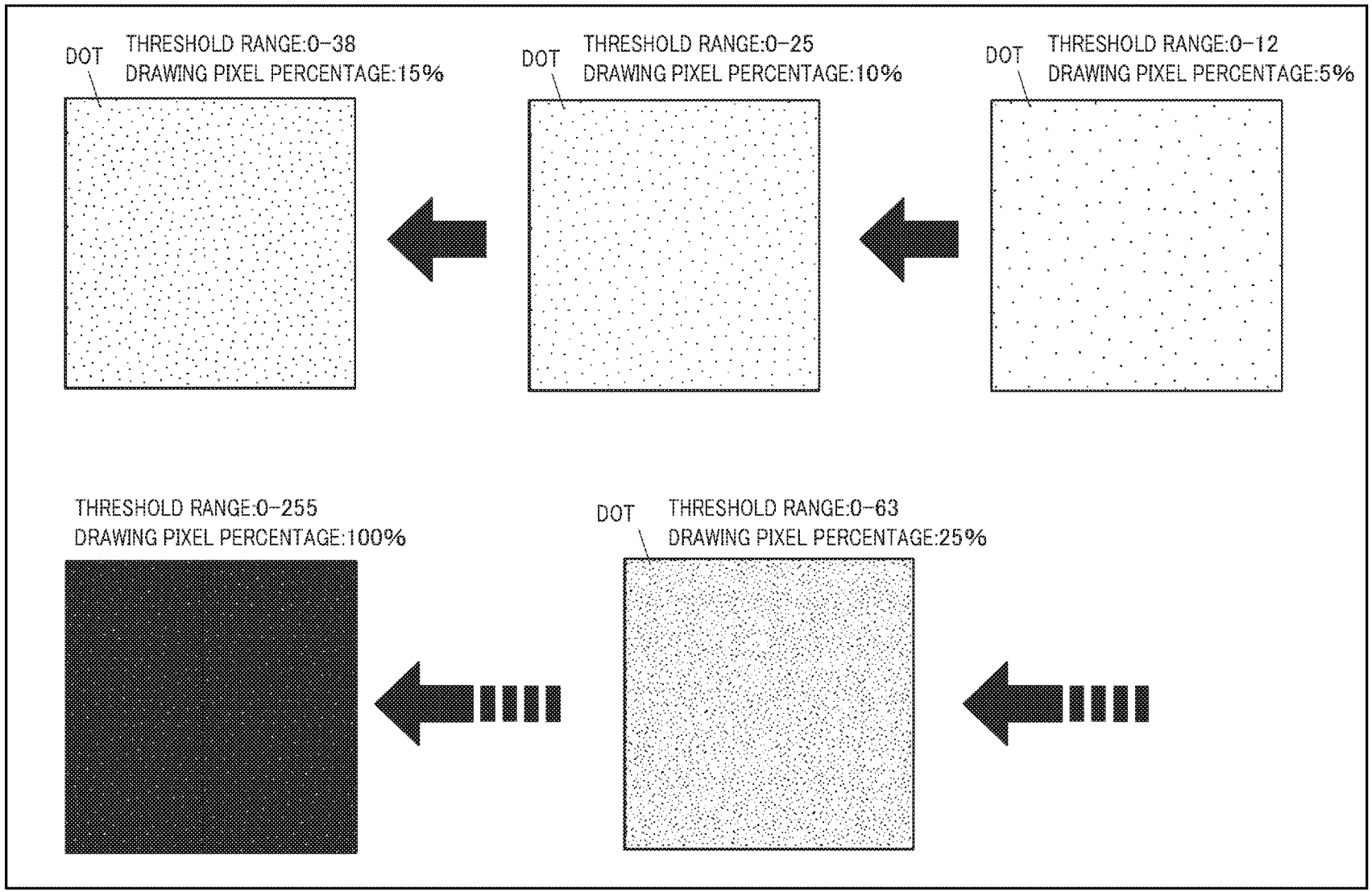

[Fig. 7]
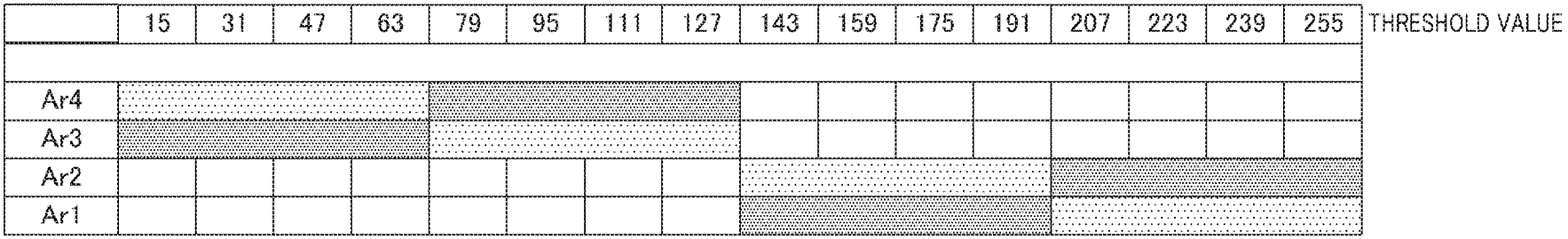

[Fig. 8]
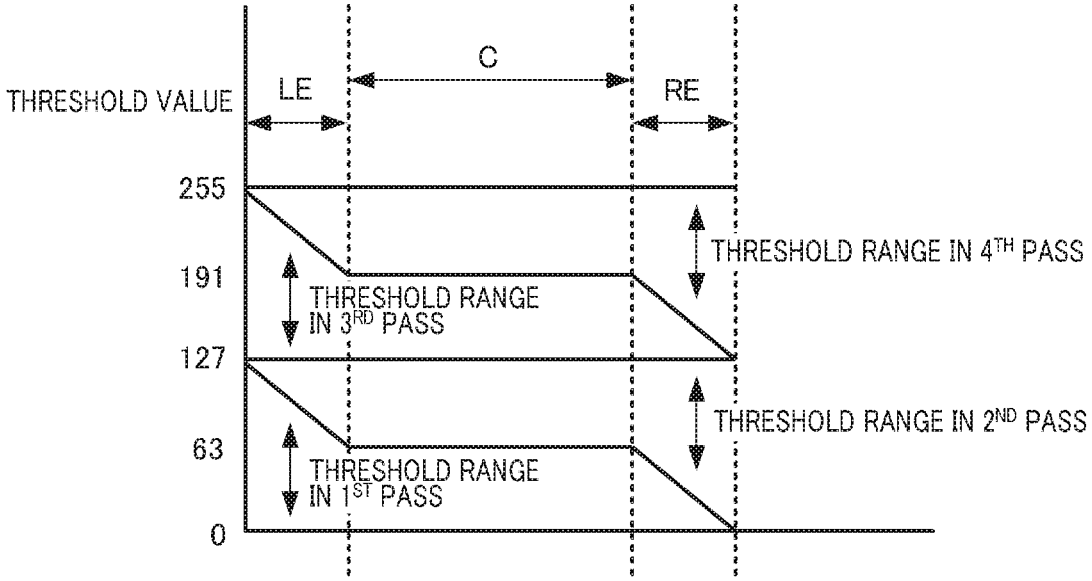

[Fig. 9]
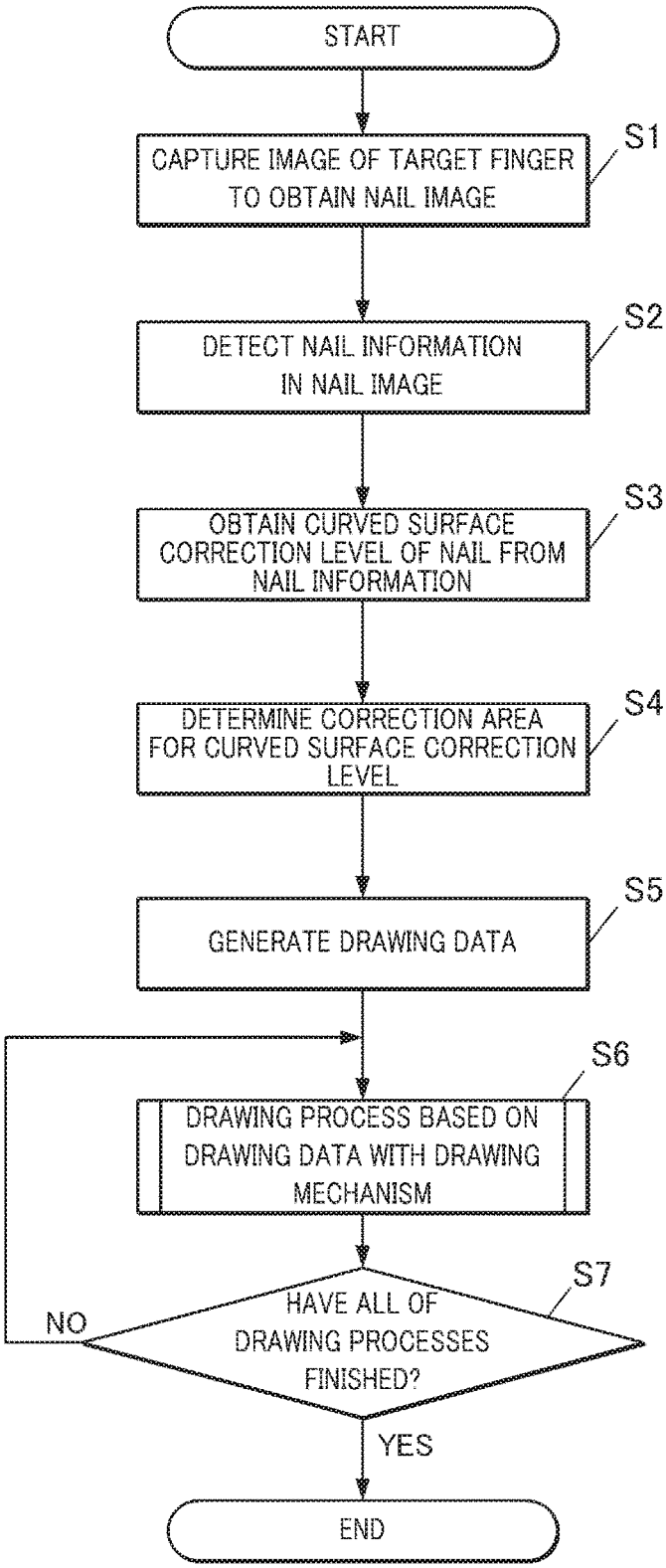

[Fig. 10]
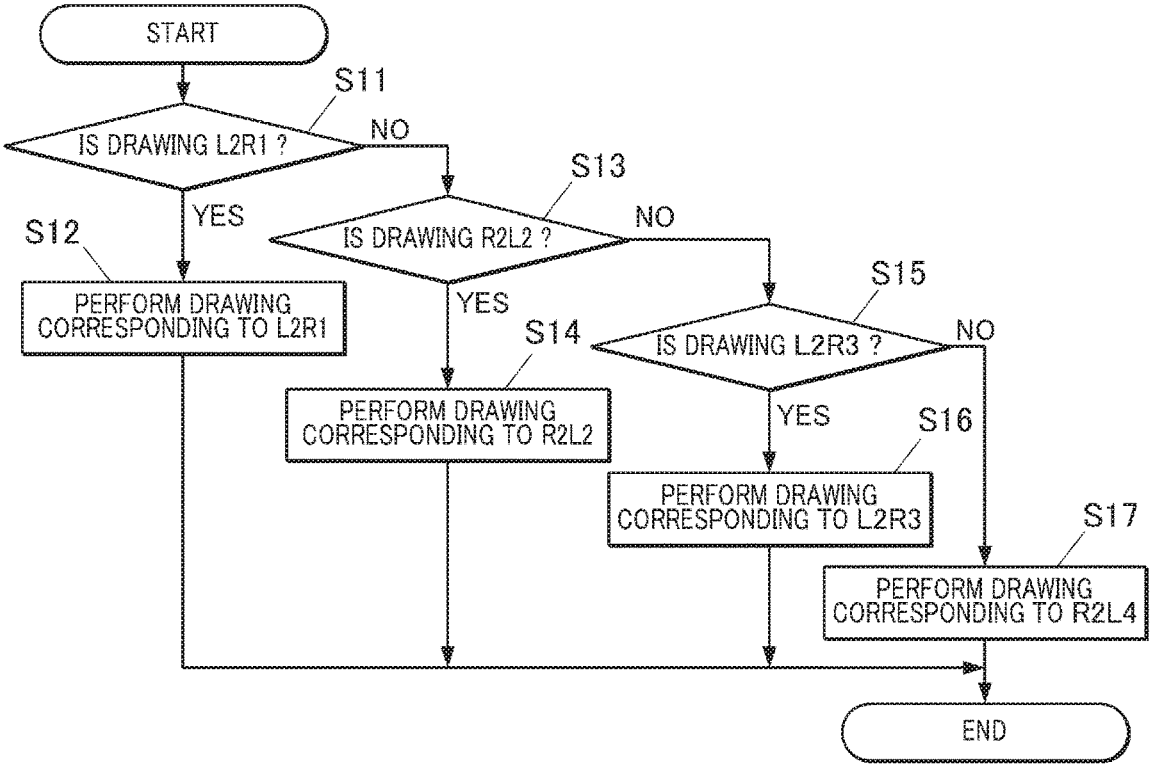
[Fig. 11]
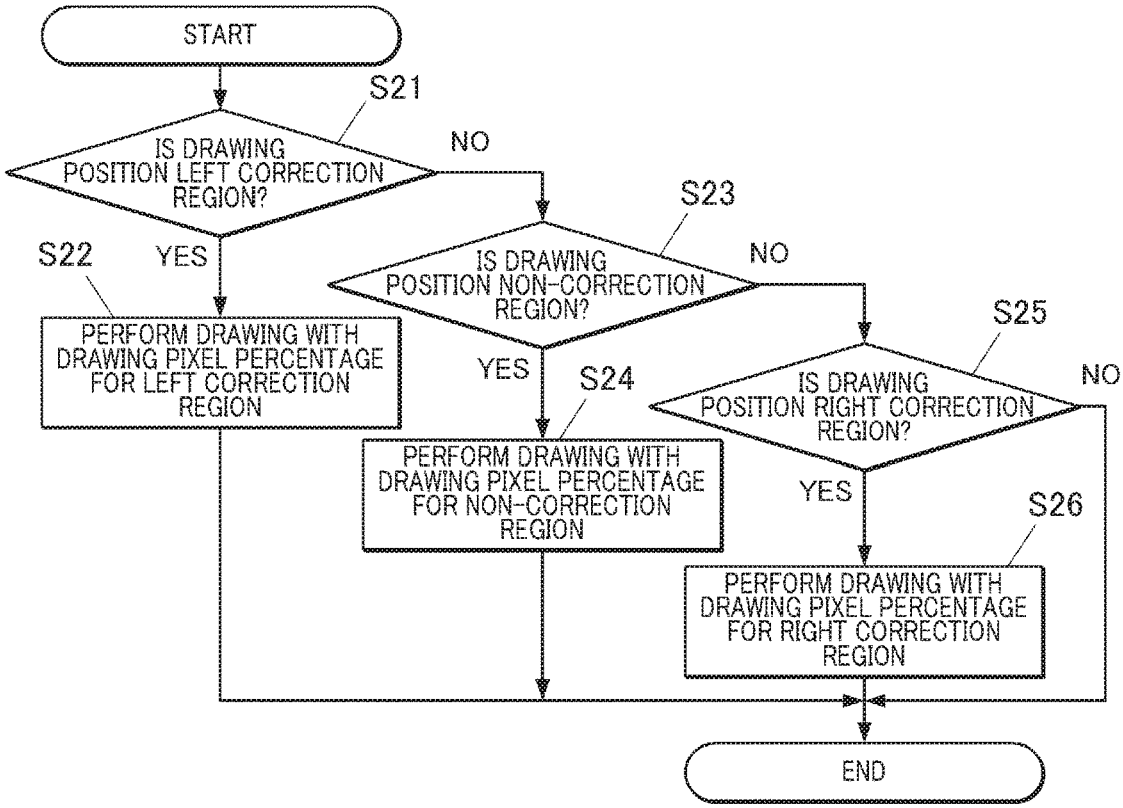

[Fig. 12A]
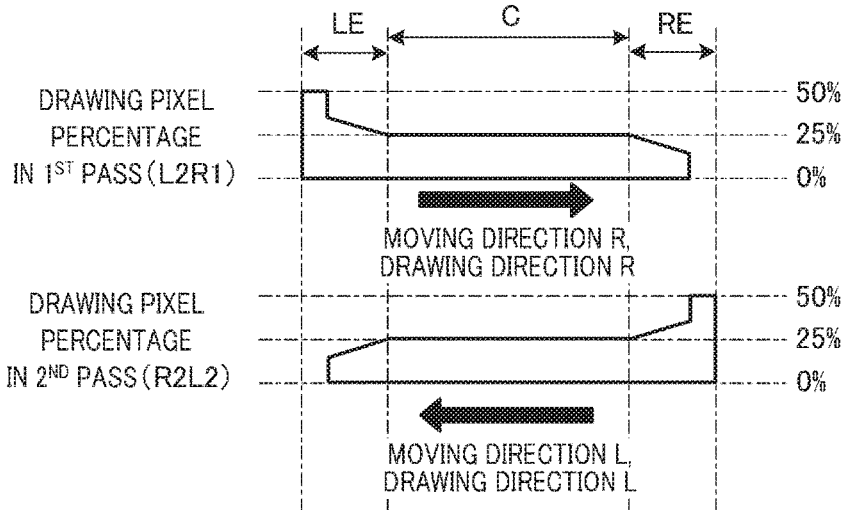
[Fig. 12B]
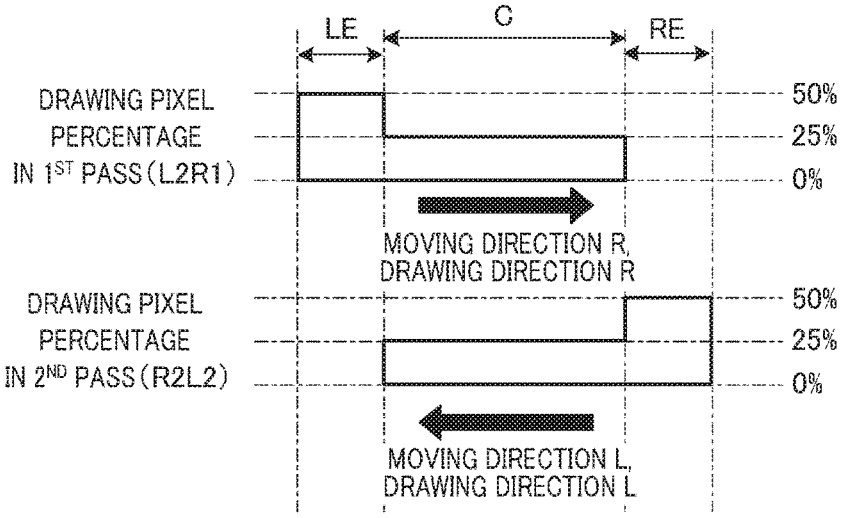
[Fig. 12C]
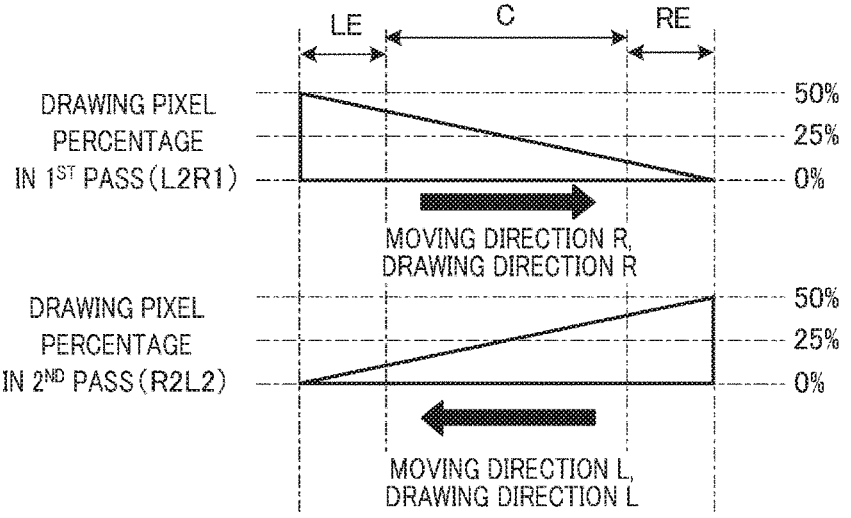

DRAWING APPARATUS AND DRAWING METHOD

CROSS-REFERENCE TO RELATED APPLICATION

This application is based upon and claims the benefit of priority from the prior Japanese Patent Application No. 2017-175298, filed on Sep. 13, 2017, the entire contents of which are incorporated herein by reference.

TECHNICAL FIELD

The present invention relates to a drawing apparatus and a drawing method.

BACKGROUND ART

There is known a drawing apparatus (nail printer) which draws desired nail designs on nails of fingers of humans. (Refer to, for example, JP 2003-534083 A.) People can readily enjoy nail printing by using this kind of apparatus without visiting nail salons or the like. As the drawing apparatus, an inkjet drawing apparatus is known.

SUMMARY OF INVENTION

Technical Problem

A human nail, which is a drawing target of a nail printer, is, as a whole, rounded and curved such that the right and left end parts in its width direction are lower than the central part in the width direction. An inkjet drawing head ejects ink and performs drawing on such a nail while moving along the width direction of the nail. On the end potions in the width direction, ink droplets land well if ejected by the drawing head which is moving in a direction to ascend a slope, but do not land or tend to land at inaccurate positions or not well if ejected by the drawing head which is moving in a direction to descend a slope. This makes a drawn image (nail design), for example, distort or have density unevenness, and image quality becomes low accordingly.

Solution to Problem

According to an aspect of the present invention, there is provided a drawing apparatus including: a drawing head which performs drawing on a drawing target surface while moving in a first direction and a second direction different from one another; and a control device which controls operation of the drawing head, wherein if the drawing target surface has a first region which is acclivitous in the first direction and declivitous in the second direction, the drawing head draws a plurality of first pixels which is to be drawn on the first region while performing a first scan in which the drawing head moves in the first direction and a second scan in which the drawing head moves in the second direction, and the control device controls a ratio of a drawing amount of a first scan drawing pixel to be drawn in a line of the first region by the drawing head during the first scan to a drawing amount required for a plurality of pixels in the line among the plurality of the first pixels to be higher than a ratio of a drawing amount of a second scan drawing pixel to be drawn in the line by the drawing head during the second scan to the drawing amount required for the plurality of the pixels in the line.

BRIEF DESCRIPTION OF DRAWINGS

The accompanying drawings, which are incorporated in and constitute a part of the specification, illustrate embodiments of the present invention, and together with the general description given above and the detailed description of the embodiments given below, serve to explain the principles of the present invention.

FIG. 1A is a front view of a drawing apparatus according to an embodiment.

FIG. 1B is a side view showing the internal configuration of the drawing apparatus shown in FIG. 1B.

FIG. 2 is a block diagram showing main components of a control system of the drawing apparatus according to the embodiment.

FIG. 3 is a plan view showing an example of a nail as a drawing target.

FIG. 4A shows nails of respective curved surface correction levels.

FIG. 4B shows a correspondence between the curved surface correction levels and correction areas.

FIG. 5 is an explanatory diagram of the amount of drawing pixels in each scan according to the embodiment.

FIG. 6 schematically shows change in density when a threshold range to a mask pattern is changed.

FIG. 7 shows four areas into which an ink ejector is divided.

FIG. 8 schematically shows threshold ranges in four scans.

FIG. 9 is a flowchart showing the overall flow of a nail printing process according to the embodiment.

FIG. 10 is a flowchart showing details of the nail printing process according to the embodiment.

FIG. 11 is a flowchart showing details of the nail printing process according to the embodiment.

FIG. 12A is an explanatory diagram showing how the amount of drawing pixels in each scan is set according to a modification.

FIG. 12B is an explanatory diagram showing how the amount of drawing pixels in each scan is set according to another modification.

FIG. 12C is an explanatory diagram showing how the amount of drawing pixels in each scan is set according to another modification.

DESCRIPTION OF EMBODIMENTS

With reference to FIG. 1 to FIG. 11, a nail printer (drawing apparatus) and a drawing method used by the nail printer (drawing apparatus) according to an embodiment of the present invention are described. Although various technically preferred limitations for carrying out the present invention are imposed on the embodiment below, the scope of the present invention is not limited to the embodiment or drawings. Further, although in the embodiment below, taking a nail of a finger as a drawing target and the surface of the nail as a drawing target surface, a nail printer 1 performs drawing, the drawing target surface of the present invention is not limited to the surface of a nail of a finger (thumb included). For example, the drawing target may be a nail of a toe, and the drawing target surface may be the surface of the nail.

FIG. 1A is a front view of the nail printer 1 and shows the internal configuration thereof. FIG. 1B is a side view showing the internal configuration of the nail printer 1 shown in FIG. 1A. As shown in FIG. 1A and FIG. 1B, the nail printer 1 of this embodiment includes a drawing mechanism 40 including a drawing head 41 as a drawing tool. The nail printer 1 is an inkjet printer which performs drawing on a nail T of a target finger U1. The nail printer 1 includes a case 2 and a body 10 housed in the case 2.

A cover 23 openable for replacement of the drawing head 41 of the drawing mechanism 40 described below is disposed on the upper part of a side face of the case 2. The cover 23 freely rotates around a hinge or the like to be in a closed state and an open state as shown in FIG. 1.

An operation unit 25 (shown in FIG. 2) is disposed on the upper face (top panel) of the case 2. The operation unit 25 is an input unit which is operated by a user to make various inputs. The operation unit 25 includes operation buttons (not shown) for making various inputs. Examples thereof include a power switch/button for turning on power of the nail printer 1, a stop switch/button for stopping operation of the nail printer 1, a design selection button for selecting/determining a design image to be drawn on the nail T, and a drawing start button (drawing switch) for making an instruction to start drawing.

A display device 26 is disposed on the central part of the upper face (top panel) of the case 2. The display device 26 is, for example, a liquid crystal display (LCD), an organic electroluminescent display or another flat display. In this embodiment, the display device 26 appropriately displays, for example, a nail image(s) (an image of the target finger U1 including an image of the nail T) obtained by photographing the target finger U1, an image(s) of the outline or the like of the nail T included in the nail image, a design menu screen for selecting a design image to be drawn on the nail T, a thumbnail image(s) for design check, and an instruction menu screen for displaying various instructions. A touchscreen for making various inputs may be integrally formed on the surface of the display device 26.

The body 10 is formed to be almost box-shaped. The body 10 includes a lower casing 11 disposed on the lower side in the case 2 and an upper casing 12 disposed above the lower casing 11 on the upper side in the case 2.

First, the lower casing 11 is described.

The lower casing 11 includes a back panel 111, a bottom panel 112, a pair of right and left side panels 113*a*, 113*b*, an X direction movement stage housing part 114, a Y direction movement stage housing part 115, and a partition 116. The lower ends of the side panels 113*a*, 113*b* are connected to the left and right ends of the bottom panel 112, respectively, such that the side panels 113*a*, 113*b* stand on the bottom panel 112. The lower part of the back panel 111 is formed to sink in two steps to the front (toward the side from which fingers are to be inserted). The lower end of the back panel 111 is connected to the front end of the bottom panel 112. The back panel 111 partitions the area defined by the bottom panel 112 and the side panels 113*a*, 113*b* into front and rear compartments. The space formed behind the sunken back panel 111 serves as the X direction movement stage housing part 114 and the Y direction movement stage housing part 115 (shown in FIG. 1B). The X direction movement stage housing part 114 houses an X direction movement stage 45 of the drawing mechanism 40 when the drawing mechanism 40 has moved forward (toward the side from which fingers are to be inserted). The Y direction movement stage housing part 115 houses a Y direction movement stage 47 of the drawing mechanism 40. The partition 116 is disposed in the lower casing 11 to partition the space on the front side in the lower casing 11 (space defined by the back panel 111, the bottom panel 112, and the side panels 113*a*, 113*b* on the side from which fingers are to be inserted) into upper and lower compartments. The partition 116 is almost horizontally disposed. The left and right ends of the partition 116 are connected to the side panels 113*a*, 113*b*, respectively. The rear end of the partition 116 is connected to the back panel 111.

The lower casing 11 is integrated with a finger holder 30 (shown in FIG. 1B). The finger holder 30 includes a finger receiver 31 which receives a finger corresponding to the nail T on which an image is to be drawn (which is hereinafter referred to as "target finger U1") and a finger waiting room 32 where the fingers except the target finger U1 (which are hereinafter referred to as "non-target fingers U2") are placed. The finger receiver 31 is disposed on the upper side of the partition 116 at the central part in the width (horizontal) direction of the lower casing 11. The lower compartment of the lower casing 11 partitioned by the partition 116 constitutes the finger waiting room 32. In order to draw an image on the nail T of, for example, a ring finger, the ring finger as the target finger U1 is inserted into the finger receiver 31, and the other four digits (thumb, index finger, middle finger and little finger) as the non-target fingers U2 are inserted into the finger waiting room 32.

As shown in FIG. 1A and FIG. 1B, the finger receiver 31 has an opening in the front face (the side from which fingers are to be inserted) of the lower casing 11, and the lower face of the finger receiver 31 is defined by a finger placing part 116*a*, which constitutes a part of the partition 116. The finger placing part 116*a* is to place, on an XY plane, a finger (target finger U1) having the nail T on which an image is to be drawn. The finger receiver 31 has a window (not shown) on the upper face to expose the nail T of the target finger U1 inserted into the finger receiver 31. On the upper face of the partition 116 and at the both side parts on the front face side of the lower casing 11, front walls 31*f* (shown in FIG. 1A) to wall up the front face side of the lower casing 11 are vertically disposed. A pair of guiding walls 31*g* (shown in FIG. 1A) to guide the target finger U1 into the finger receiver 31 is vertically disposed on the upper face of the partition 116 from the center-side ends of the front walls 31*g* to the depth of the finger receiver 31 such that the space defined by the guiding walls 31*g* tapers off toward the depth of the finger receiver 31. The user can pinch the partition 116 with the target finger U1 inserted into the finger receiver 31 and the non-target fingers U2 inserted into the finger waiting room 32. This stabilizes the target finger U1 inserted into the finger receiver 31.

A home area 60 for the drawing head 41 described below to stand by during non-drawing (standby mode) is provided in a movable area of the drawing head 41 on the upper face of the lower casing 11 and adjacent to the finger receiver 31 (on the right in FIG. 1A). An inkjet maintenance unit is disposed in the home area 60 so as to face the drawing head 41 in the standby mode. The inkjet maintenance unit includes a cleaning mechanism (not shown) for cleaning an inkjet ejector 411 (nozzle surface) of the drawing head 41 described below and a capping mechanism (not shown) for maintaining a moist state of the ink ejector 411 (nozzle surface). Arrangement of the inkjet maintenance unit in the home area 60 is not limited to the one described above.

The drawing mechanism 40 includes the drawing head 41, a unit support member 44 which supports the drawing head 41, the X direction movement stage 45 which moves the drawing head 41 in an X direction (X direction in FIG. 1A, i.e. right-left direction of the drawing apparatus 1), an X direction movement motor 46, the Y direction movement stage 47 which moves the drawing head 41 in a Y direction (Y direction in FIG. 1B, i.e. front-back direction of the drawing apparatus 1), and a Y direction movement motor 48.

In this embodiment, the drawing mechanism 40, with the drawing head 41, performs drawing on the surface of the nail T while scanning the surface of the nail T an even number of times between one end and the other end along the width direction, wherein the surface of the nail T is the drawing target surface curved so as to have an acclivity and a declivity from one end to the other end along the width direction. How the drawing mechanism 40 (the drawing head 41 of the drawing mechanism 40) performs drawing is detailed below.

In this embodiment, the drawing head 41 is held by a head holder 43 and disposed on the unit support member 44. The drawing head 41 is an ink-cartridge-integrated head configured such that ink cartridges (not shown), for example, for yellow (y), magenta (M) and cyan (C) inks are integrated with the ink ejector 411 (shown in FIG. 7) disposed on the faces of the ink cartridges, the faces facing the drawing target (nail T) (the lower face of the drawing head 41 in FIG. 1A, etc. in this embodiment). The ink ejector 411 includes a nozzle array constituted of nozzles to jet the color inks. The drawing head 41 makes the inks fine droplets and jets the fine droplets from the ink ejector 411 directly onto the surface of the drawing target (the surface of the nail T) in units of pixels, thereby performing drawing. The nozzles for jetting the inks each include a piezoelectric element (not shown) and can be individually controlled for ink jetting by a drawing control section 814 (shown in FIG. 2) described below. In this embodiment, the ink ejector 411 is divided into four areas (Ar1 to Ar4), and the nozzles in the areas are successively driven (shown in FIG. 7), so that drawing is performed on a plurality of pixels P. The drawing head 41 may eject ink of any color other than the three colors mentioned above, and accordingly may include other ink cartridges storing ink of other colors and an ink ejector(s). Further, the nozzles of the drawing head 41 are not limited to those for ejecting ink with piezoelectric elements, and may have any configuration as far as they can be individually controlled for ink jetting. For example, the nozzles may be thermal nozzles provided with heaters.

The unit support member 44 is fixed to an X direction movement part 451 attached to the X direction movement stage 45. The X direction movement part 451 moves on the X direction movement stage 45 in the X direction along a guide (not shown) by being driven by the X direction movement motor 46. This moves the drawing head 41 attached to the unit support member 44 in the X direction (X direction in FIG. 1A, i.e. right-left direction of the nail printer 1). The X direction movement stage 45 is fixed to a Y direction movement part 471 of the Y direction movement stage 47. The Y direction movement part 471 moves on the Y direction movement stage 47 in the Y direction along a guide (not shown) by being driven by the Y direction movement motor 48. This moves the drawing head 41 attached to the unit support member 44 in the Y direction (Y direction in FIG. 1B, i.e. front-back direction of the nail printer 1). In this embodiment, the X direction movement stage 45 is configured by being combined with the X direction movement motor 46, a ball screw(s) (not shown) and the guide, and the Y direction movement stage 47 is configured by being combined with the Y direction movement motor 48, a ball screw(s) (not shown) and the guide. In this embodiment, the X direction movement motor 46, the Y direction movement motor 48 and so forth constitute a head mover 49 as an XY drive unit which drives the drawing head 41 in the X direction and the Y direction.

The drawing head 41, the X direction movement motor 46 and the Y direction movement motor 48 of the drawing mechanism 40 are connected to and controlled by the drawing control section 814 (shown in FIG. 2) of a control device 80 described below.

An imaging mechanism 50 includes an imager 51 and illuminators 52. The illuminators 52 of the imaging mechanism 50 illuminate the nail T (the target finger U1 including the nail T) inserted into the finger receiver 31 and exposed through the window. The imager 51 captures an image of the target finger U1 to obtain a nail image which is an image of the target finger U1 (an image of the finger including the nail image of the nail T). As shown in FIG. 1A and FIG. 1B, in this embodiment, the imager 51 and the illuminators 52 are disposed on the upper casing 12. More specifically, the imager 51 and the illuminators 52 of the imaging mechanism 50 are disposed on the lower face of a substrate 13 disposed on the upper casing 12 so as to face the partition 116. Positions of the imager 51 and the illuminators 52 attached to the substrate 13 are not limited to those shown in the drawings.

The imager 51 is, for example, a compact imager including a solid state imaging sensor having about two million or more imaging pixels (which are not drawing pixels described below) and a lens. In this embodiment, the imager 51 of the imaging mechanism 50 captures an image of the target finger U1 including the nail T to obtain a nail image. A nail information detection section 812 described below detects, in the nail image, the position and shape of the target finger U1, the position and shape (outline of the nail T) of the nail T as the drawing target, an aspect ratio of the nail T, and so forth.

The illuminators 52 are, for example, white LEDs. In this embodiment, four illuminators 52 are disposed on the right, left, front and back of the imager 51 so as to surround the imager 51. The illuminators 52 emit light downward to illuminate an imaging area beneath the imager 51. The number arrangement and so forth of the illuminators 52 are not limited to those shown in the drawings. The imaging mechanism 50 is connected to and controlled by an imaging control section 811 (shown in FIG. 2), described below, of the control device 80. Image data on the image (i.e. nail image) captured by the imaging mechanism 50 is stored in a nail image storage region 821 of a storage 82 described below.

The control device 80 is, for example, disposed on the substrate 13 disposed on the upper casing 12. FIG. 2 is a block diagram showing main components of a control system according to this embodiment. As shown in FIG. 2, the control device 80 is a computer including a controller 81 and the storage 82. The controller 81 includes a central processing unit (CPU) (not shown), and the storage 82 includes a read only memory (ROM) and a random access memory (RAM) (both not shown).

The storage 82 stores various programs and various data for operating the nail printer 1. More specifically, the ROM of the storage 82 stores various programs including a nail information detection program for detecting the position and shape (outline) of the target finger U1, the position and shape (outline) of the nail T, the aspect ratio of the nail T and so forth, a drawing data generation program for generating data for drawing (drawing data) by performing curved surface correction and so forth on image data on a nail design, and a drawing program for a drawing process. The control device 80 executes these programs, thereby controlling the components of the nail printer 1 in whole. In this embodiment, the storage 82 includes the nail image storage region 821 storing the nail image(s) of the nail T of the target finger U1 of the user captured by the imaging mechanism 50, a nail information storage region 822 storing nail information (the outlines of the target finger U1 and the nail T, the aspect ratio of the nail T, etc.) detected by the nail information detection section 812, a nail design storage region 823 storing image data on the nail design(s) to be drawn on the nail T as the drawing target, and a data-for-correction storage region 824 storing data necessary for the correction according to a curved surface correction level of the nail T described below.

The controller 81 includes, in terms of functions, the imaging control section 811, the nail information detection section 812, a drawing data generation section 813, the drawing control section 814 and a display control section 815. The CPU of the controller 81 operates to function as the imaging control section 811, the nail information detection section 812, the drawing data generation section 813, the drawing control section 814, the display control section 815 and so forth in cooperation with the programs stored in the ROM of the storage 82.

The imaging control section 811 controls the imager 51 and the illuminators 52 of the imaging mechanism 50 to cause the imager 51 to capture an image of the target finger U1 (an image of the target finger U1 including an image of the nail T, i.e. "nail image") inserted into the finger receiver 31. Image data on the nail image obtained by the imaging mechanism 50 is stored in the nail image storage region 821 of the storage 82. In this embodiment, as the nail information, the outlines of the target finger U1 and the nail T, the aspect ratio of the nail T and so forth are detected in the nail image obtained by the imaging mechanism 50. The nail information detected in the nail image is, however, not limited thereto, and for example, curvature of the nail T may be detected on the basis of the nail image directly.

The nail information detection section 812 detects, in the nail image, which is an image of the target finger U1 including the nail T obtained by the imager 51 of the imaging mechanism 50, the outline of the finger defining the region of the target finger U1, the outline (shape) of the nail T defining the region of the nail T as the drawing target, and a curved surface level indicating curvature (degree of curve) of the surface of the nail T as the drawing target in the nail width direction, and so forth. The nail information detection section 812 detects the shapes (outlines) of the target finger U1 and the nail T as the nail information on the basis of, for example, color difference between each of the target finger U1 and the nail T and the background (the finger placing part 116*a* in this embodiment), or obtains the shape (outline) of the nail T by detecting the boundary between the nail T and the skin of the target finger U1 on the basis of (i) color difference between the nail T and the target finger U1, (ii) how shadows appear, and so forth. If a plurality of nail images has been obtained by the imaging mechanism 50 performing imaging multiple times while changing irradiation angle of the illuminators 52, the nail information detection section 812 determines the curvature of the surface of the nail T in the width direction on the basis of the darkness of the shadows appearing in the nail images, and obtains the curved surface correction level indicating what level of the correction is needed. As shown in FIG. 4A described below, the curved surface correction level includes information corresponding to the curvature of the surface of the nail T at each of points at predetermined intervals in the horizontal direction, namely, the tilt of the surface of the nail T from the horizontal. The method for detecting the nail information with the nail information detection section 812 is not limited to those described herein and may be any method. Further, although the curved surface correction level is detected by the nail information detection section 812 in the above, the curved surface level may not be detected by the nail information detection section 812, and a standard value as the curved surface correction level may be preset and changed by the user, for example.

FIG. 3 is a schematic view showing the nail T as the drawing target. FIG. 3 includes a plan view of the surface of the nail T as the drawing target surface viewed from the above and a front view of the nail T viewed from the tip side, where "W" represents an apparent width when the nail surface is viewed from the above as a plane. In FIG. 3, "C" represents a non-correction region which is a relatively flat central region of the nail T in the nail width direction and requires no curved surface correction, and "LE" and "RE" represent a left correction region and a right correction region, respectively, which are left and right curved regions of the nail T in the nail width direction and requires the curved surface correction. As shown in FIG. 3, the surface of the nail T as the drawing target surface is curved such that one end E1 and the other end E2 in the width direction are relatively low, and the central part in the width direction is relatively high. If the drawing head 41 ejects ink droplets to such a drawing target surface while moving (scanning the drawing target surface) in the direction from the one end E1 to the other end E2 along the width direction of the nail T, the travelling direction (ejection direction) of the ejected ink droplets is, as indicated by d in FIG. 3, a direction inclined to the moving direction of the drawing head 41 from the vertical direction. The ink droplets land well at a low part(s)/region(s) in height of the surface of the nail T too if ejected from the drawing head 41 which is scanning, of the surface of the nail T, a region acclivitous in the moving direction of the drawing head 41. On the other hand, while the drawing head 41 is scanning, of the surface of the nail T, a region declivitous in the moving direction of the drawing head 41, angle between the travelling direction d of the ink droplets ejected from the drawing head 41 (shown with long dashed double-short dashed lines at the upper side in FIG. 3) and the inclined direction of the surface of the nail T is small. Consequently, the ejected ink droplets hardly land or land at inaccurate positions, and ink-droplets poor landing occurs. Hence, in this embodiment, the central part of the nail T in the width direction is regarded as the non-correction region C, which does not require the correction, a predetermined width region on the left of the non-correction region C is regarded as the left correction region LE, a predetermined width region on the right of the non-correction region C is regarded as the right correction region RE, and the correction is performed in the left correction region LE and the right correction region RE.

More specifically, the nail information detection section 812 categorizes the nail T on the basis of the curvature of the nail T as one of six curved surface correction levels of 0 to 5 shown in FIG. 4A. The method for categorizing the nail T as one of the curved surface correction levels with the nail information detection section 812 is not particularly limited. For example, in the data-for-correction storage region 824 of the storage 82, threshold values or the like for the respective curved surface correction levels are stored, and referring to the threshold values, the nail information detection section 812 determines as which of the curved surface correction levels, the nail T of the user is categorized, when detecting the shape of the surface of the nail T. The number of the curved surface correction levels is not limited to six as shown in FIG. 4A, and may be three or less, or seven or more for more specific categorization. In FIG. 4A, the "curved surface correction level 0" represents a curved surface level of a substantially flat surface of the nail T, the "curved surface correction level 1" represents a curved surface level of an overall flat surface of the nail T having a relatively small curvature, the "curved surface correction level 5" represents a curved surface level of a curved surface of the nail T having a relatively large curvature, and the "curved surface correction level 2", the "curved surface correction level 3" and the "curved surface correction level 4" represent curved surface levels of a typical/standard surface of the nail T having a curvature between that of the "curved surface correction level 1" and that of the "curved surface correction level 5" and increase curvature in this order, and they are provided with the threshold values.

As shown in FIG. 4B, in the data-for-correction storage region 824, a table in which correction areas are correlated with the respective curved surface correction levels 0 to 5 is stored. The correction areas each specify the width of each correction region, where the correction is performed, in percentage (%) in the nail width W. For example, if the nail T is categorized as the curved surface correction level 1, a 5% width region from the left end of the nail T is the left correction region LE, a 5% width region from the right end of the nail T is the right correction region RE, and the remaining central part is the non-correction region C. If the nail T is categorized as the curved surface correction level 5, a 25% width region from the left end of the nail T is the left correction region LE, a 25% width region from the right end of the nail T is the right correction region RE, and the remaining central part is the non-correction region C.

The drawing data generation section 813 generates data necessary to draw the nail design on the nail T of the target finger U1 with the drawing head 41. The drawing data generation section 813 generates the drawing data for fitting the nail design chosen by the user to the shape of the nail of the user and controlling, on the basis of the curved surface correction level detected by the nail information detection section 812, which pixel(s) are to be drawn (i.e. which nozzle(s) of the ink ejector 411 of the drawing head 41 for pixel(s) are to be driven) in which scan among scans. The drawing control section 814 controls the drawing head 41 to scan the surface of the nail as the drawing target surface multiple times while driving all or some of the nozzles on the basis of the drawing data generated by the drawing data generation section 813, thereby drawing pixels and accordingly forming an image constituted of the drawn pixels combined. In this embodiment, the drawing control section 814 causes the drawing head 41 to reciprocate on the nail T and form an image during four scans (four passes). The drawing control section 814 outputs control signals to the drawing mechanism 40 on the basis of the drawing data generated by the drawing data generation section 813 so as to control the X direction movement motor 46, the Y direction movement motor 48, the drawing head 41 and so forth of the drawing mechanism 40 to perform drawing on the nail T on the basis of the drawing data.

In this embodiment, the drawing data generation section 813 and the drawing control section 814 constitute a control unit which controls drawing operation of the drawing mechanism 40.

In this embodiment, the drawing mechanism 40 performs drawing on the drawing target surface while scanning the surface of the nail T as the drawing target surface an even number of times from one end to the other end and from the other end to the one end along the width direction of the nail T. At the time, the drawing data generation section 813 and the drawing control section 814, which constitute the control unit that controls the drawing operation of the drawing mechanism 40, change the amount of drawing pixels to be drawn on the region of the drawing target surface (the surface of the nail T) acclivitous in the moving direction of the drawing head 41 during a scan(s) of the acclivitous region so as to reduce the amount from a large amount to a small amount from the starting point of the scan of the acclivitous region in the moving direction of the drawing head 41. Further, the drawing data generation section 813 and the drawing control section 814 change the amount of the drawing pixels to be drawn on the region of the drawing target surface (the surface of the nail T) declivitous in the moving direction of the drawing head 41 during the scan of the declivitous region so as to reduce the amount from, at the largest, the amount at the ending point of the scan of the acclivitous region from the starting point of the scan of the declivitous region in the moving direction of the drawing head 41. Note that the drawing pixels are pixels to be drawn by the drawing head 41 during scans. Still further, the drawing data generation section 813 and the drawing control section 814 control the drawing operation of the drawing mechanism 40 such that change in the amount of the drawing pixels during one scan and change in the amount of the drawing pixels during another scan which is paired with the one scan among the even number of scans complement one another, namely, such that change in the amount of the drawing pixels during a first scan from one end to the other end on an outward way and change in the amount of the drawing pixels during a second scan from the other end to the one end on a homeward way complement one another.

Hereinafter, with reference to FIG. 5 to FIG. 11, the control on the drawing operation of the drawing mechanism 40 by the drawing data generation section 813 and the drawing control section 814 is described. FIG. 5 is an explanatory diagram of percentage of the amount of the drawing pixels to be drawn by the drawing mechanism 40 (which is hereinafter referred to as "drawing pixel percentage") during each scan according to this embodiment. In this embodiment, in the $1^{st}$ and $3^{rd}$ scans, the moving direction of the drawing head 41 is the right direction R, and in the $2^{nd}$ and $4^{th}$ scans, the moving direction of the drawing head 41 is the left direction L. A direction orthogonal to the moving direction is referred to as a line direction. Pixels to be drawn on the nail T by the drawing head 41 are arranged in the moving direction and the line direction to be a matrix. In the case where W represents the width of the nail T, and the curved surface correction level is 4 and the correction area is 20% accordingly, a W×20/100 region from the left end of the nail T in the width direction is the left correction region LE (first region or second region), a W×20/100 region from the right end of the nail T in the width direction is the right correction region RE (second region or first region), and the remaining central part corresponding to 60% of the width W of the nail T is the non-correction region C, where the correction is not performed. Hereinafter, a case is described in which on the surface of the nail T as the drawing target surface, singling printing is performed with four scans (passes). Pixel lines of the left correction region LE are referred to as the $1^{st}$ line, the $2^{nd}$ line, the $3^{rd}$ line, . . . and the $a^{th}$ line from the left end, and pixel lines of the right correction region RE are referred to as the $b^{th}$ line, . . . , the $c^{th}$ line, . . . and the $d^{th}$ line from the right end. The number of the pixels P in each line depends on the shape and the size of the nail T, and hence may be different from line to line.

In FIG. 5 and so forth, in the $1^{st}$ pass ($1^{st}$ scan), the drawing head 41 moves from the left to the right (from the left to the right in FIG. 5), thereby performing a scan ($1^{st}$ scan), and the moving direction (drawing direction) of the drawing head 41 is the right direction R (first direction or second direction). Drawing during this scan is referred to as "L2R1" in FIG. 5 and so forth. In the $2^{nd}$ pass ($2^{nd}$ scan), the drawing head 41 moves from the right to the left (from the right to the left in FIG. 5), thereby performing a scan ($2^{nd}$ scan), and the moving direction (drawing direction) of the drawing head 41 is the left direction L (second direction or first direction). Drawing during this scan is referred to as "R2L2" in FIG. 5 and so forth. Similarly, in the $3^{rd}$ pass ($3^{rd}$ scan), the drawing head 41 moves from the left to the right (from the left to the right in FIG. 5), thereby performing a scan ($3^{rd}$ scan), and the moving direction (drawing direction) of the drawing head 41 is the right direction R (first direction or second direction). Drawing during this scan is referred to as "L2R3" in FIG. 5 and so forth. In the $4^{th}$ pass ($4^{th}$ scan), the drawing head 41 moves from the right to the left (from the right to the left in FIG. 5), thereby performing a scan ($4^{th}$ scan), and the moving direction (drawing direction) of the drawing head 41 is the left direction L (second direction or first direction). Drawing during this scan is referred to as "R2L4" in FIG. 5 and so forth.

According to a conventional ordinary method, for example, in each of the $1^{st}$ pass ($1^{st}$ scan) to the $4^{th}$ pass ($4^{th}$ scan), in the entire region of the nail T in the width direction, 25% of all the pixels constituting a design image to be drawn are drawn so that all the pixels are drawn by the four passes (scans). Meanwhile, according to this embodiment, in each scan, in the left correction region LE and the right correction region RE set at both end parts of the nail T in the width direction, the amount of pixels to be drawn (drawing pixels) by the drawing mechanism 40 among all the pixels constituting a design image to be drawn thereby is changed according to the movement of the drawing head 41 during each scan.

More specifically, in this embodiment, as shown in FIG. 5, by L2R1 in the $1^{st}$ pass (the $1^{st}$ scan) from the left to the right (moving direction R in FIG. 5), drawing on the pixels P to be drawn is performed from the left correction region LE to the right correction region RE.

At the starting point (left end E1) in the left correction region LE, namely, in the $1^{st}$ line of the left correction region LE, the ratio of the drawing amount of the drawing pixels to be drawn (first scan drawing pixel(s) or third scan drawing pixel(s)) in the $1^{st}$ line during the $1^{st}$ scan to the drawing amount (at least one of the area of drawing (drawing area), the number of the drawing pixels and the number of dots as ink marks deposited in the nail T by drawing) required for all the pixels P to be drawn in the $1^{st}$ line (i.e. "drawing pixel percentage") of a design image is 50%; at the ending point in the left correction region LE (a border side of the left correction region LE with the non-correction region C), namely, in the $a^{th}$ line of the left correction region LE, the ratio of the drawing amount of the drawing pixels to be drawn (first scan drawing pixel(s) or third scan drawing pixel(s)) in the $a^{th}$ line during the $1^{st}$ scan to the drawing amount required for all the pixels P to be drawn in the $a^{th}$ line of the design image is 25%; and from the $1^{st}$ line to the $a^{th}$ line of the left correction region LE, the ratio of the drawing amount of the drawing pixels to be drawn in each line during the $1^{st}$ scan to the drawing amount required for all the pixels P to be drawn in each line is changed to be reduced from 50% to 25%. In the non-correction region C, namely, from the $(a+1)^{th}$ line to the $(b-1)^{th}$ line, the ratio of the drawing amount of the drawing pixels to be drawn in each line during the $1^{st}$ scan to the drawing amount required for all the pixels P to be drawn in each line is 25%.

At the starting point in the right correction region RE (a border side of the right correction region RE with the non-correction region C), namely, in the $b^{th}$ line of the right correction region RE, the ratio of the drawing amount of the drawing pixels to be drawn (third scan drawing pixel(s) or first scan drawing pixel(s)) in the $b^{th}$ line during the $1^{st}$ scan to the drawing amount required for all the pixels P to be drawn in the $b^{th}$ line of the design image is 25%; at the ending point in the right correction region RE, namely, in the $d^{th}$ line of the right correction region RE, the ratio of the drawing amount of the drawing pixels to be drawn (third scan drawing pixel(s) or first scan drawing pixel(s)) in the $d^{th}$ line during the $1^{st}$ scan to the drawing amount required for all the pixels P to be drawn in the $d^{th}$ line of the design image is 0%; and from the $b^{th}$ line to the $d^{th}$ line of the right correction region RE, the ratio of the drawing amount of the drawing pixels to be drawn in each line during the $1^{st}$ scan to the drawing amount required for all the pixels P to be drawn in each line is changed to be reduced from 25% to 0%.

Thus, as shown by "L2R1" in the $1^{st}$ pass ($1^{st}$ scan) in FIG. 5, in the left correction region LE, the drawing pixel percentage at the left end is 50%, and drawing is performed while the drawing pixel percentage is gradually reduced to 25% from line to line; in the non-correction region C, drawing is performed while the drawing pixel percentage is kept at 25%; and in the right correction region RE, drawing is performed while the drawing pixel percentage is gradually reduced from 25% to 0% from line to line.

Further, by R2L2 in the $2^{nd}$ pass (the $2^{nd}$ scan) from the right to the left (moving direction L in FIG. 5) which is paired with L2R1 in the $1^{st}$ pass ($1^{st}$ scan), drawing on the pixels P to be drawn is performed from the right correction region RE to the left correction region LE.

At the starting point (right end E2) in the right correction region RE, namely, in the $d^{th}$ line of the right correction region RE, the ratio of the drawing amount of the drawing pixels to be drawn (fourth scan drawing pixel(s) or second scan drawing pixel(s)) in the $d^{th}$ line during the $2^{nd}$ scan to the drawing amount (at least one of the area of drawing (drawing area), the number of the drawing pixels and the number of dots as ink patterns in the nail T by drawing) required for all the pixels P to be drawn in the $d^{th}$ line (i.e. "drawing pixel percentage") of the design image is 50%; at the ending point in the right correction region RE (a border side of the right correction region RE with the non-correction region C), namely, in the $b^{th}$ line of the right correction region RE, the ratio of the drawing amount of the drawing pixels to be drawn (fourth scan drawing pixel(s) or second scan drawing pixel(s)) in the $d^{th}$ line during the $2^{nd}$ scan to the drawing amount required for all the pixels P to be drawn in the $b^{th}$ line of the design image is 25%; and from the $d^{th}$ line to the $b^{th}$ line of the right correction region RE, the ratio of the drawing amount of the drawing pixels to be drawn in each line during the $2^{nd}$ scan to the drawing amount required for all the pixels P to be drawn in each line is changed to be reduced from 50% to 25%. In the non-correction region C, namely, from the $(b-1)^{th}$ line to the $(a+1)^{th}$ line, the ratio of the drawing amount of the drawing pixels to be drawn in each line during the $2^{nd}$ scan to the drawing amount required for all the pixels P to be drawn in each line is 25%.

At the starting point in the left correction region LE (a border side of the left correction region LE with the non-correction region C), namely, in the $a^{th}$ line of the left correction region LE, the ratio of the drawing amount of the drawing pixels to be drawn (second scan drawing pixel(s) or fourth scan drawing pixel(s)) in the $a^{th}$ line during the $2^{nd}$ scan to the drawing amount required for all the pixels P to be drawn in the $a^{th}$ line of the design image is 25%; at the ending point in the left correction region LE, namely, in the $1^{st}$ line of the left correction region LE, the ratio of the drawing amount of the drawing pixels to be drawn (second scan drawing pixel(s) or fourth scan drawing pixel(s)) in the $1^{st}$ line during the $2^{nd}$ scan to the drawing amount required for all the pixels P to be drawn in the $1^{st}$ line of the design image is 0%; and from the $a^{th}$ line to the $1^{st}$ line of the left correction region LE, the ratio of the drawing amount of the drawing pixels to be drawn in each line during the $2^{nd}$ scan to the drawing amount required for all the pixels P to be drawn in each line is changed to be reduced from 25% to 0%. Thus, as shown by "R2L2" in the $2^{nd}$ pass ($2^{nd}$ scan) in FIG. 5, in the right correction region RE, the drawing pixel percentage at the right end is 50%, and drawing is performed while the drawing pixel percentage is gradually reduced to 25% from line to line; in the non-correction region C, drawing is performed while the drawing pixel percentage is kept at 25%; and in the left correction region LE, drawing is performed while the drawing pixel percentage is gradually reduced from 25% to 0% from line to line.

As a result, if the schematic transition diagram of the amount of the drawing pixels by L2R1 in the $1^{st}$ pass ($1^{st}$ scan) in FIG. 5 is vertically inverted, and this vertically inverted schematic transition diagram is combined with the schematic transition diagram of the amount of the drawing pixels by R2L2 in the $2^{nd}$ pass ($2^{nd}$ scan) in FIG. 5 such that their end parts of the nail T in the width direction are fitted to one another, the drawing pixel percentage in each line in the $1^{st}$ pass and the $2^{nd}$ pass is approximately uniform at 50% across the entire region from the left end to the right end. More specifically, pixels not drawn (no-drawing pixels) during the first scan from one end to the other end of the nail T in the width direction on the outward way (L2R1 in FIG. 5) are drawn during the second scan from the other end to the one end of the nail T in the width direction on the homeward way (R2L2 in FIG. 5), so that change in the drawing pixel percentage during the first scan on the outward way (L2R1 in FIG. 5) and change in the drawing pixel percentage during the second scan on the homeward way (R2L2 in FIG. 5) have a mutually complementary relationship. The same applies to L2R3 in the $3^{rd}$ pass ($3^{rd}$ scan) and R2L4 in the $4^{th}$ pass ($4^{th}$ scan) in FIG. 5. Thus, in this embodiment, drawing can be performed in both outward and homeward directions in which scans are performed along the width direction of the nail T, and there is a point(s) where drawing is performed during a scan(s) in one of the directions only. The drawing data generation section 813 and the drawing control section 814, which constitute the control unit that controls the drawing operation of the drawing mechanism 40, adjust/determine the correction area, where the amount of the drawing pixels is corrected so as not to remain the same, according to the curvature (i.e. the curved surface correction level) of the surface of the nail T as the drawing target surface, and control degree of change in the amount of the drawing pixels to be drawn by the drawing mechanism 40. Further, in this embodiment, as shown in each schematic transition diagram of the amount of the drawing pixels in FIG. 5, the drawing data generation section 813 and the drawing control section 814 control the amount of the drawing pixels to be drawn by the drawing mechanism 40 to change linearly. This can prevent streaks or the like from appearing between the region where the amount of the drawing pixels is adjusted (i.e. the left correction region LE or the right correction region RE) and the region where the amount of the drawing pixels is not adjusted (i.e. the non-correction region C), and can realize beautifully finished nail prints.

Hereinafter, how to sort the drawing pixels to be drawn from the non-drawing pixels not to be drawn during each scan is detailed. In this embodiment, in the data-for-correction storage region 824 of the storage 82 or the like, data on a mask pattern(s) (singling mask(s)) having randomly arranged dots is stored. The drawing data generation section 813, which constitutes a part of the control unit that controls the drawing operation of the drawing mechanism 40, controls the percentage of the drawing amount of the drawing pixels (i.e. the drawing pixel percentage) to be drawn by the drawing mechanism 40 with the dots of the mask pattern. FIG. 6 shows examples of the mask pattern (singling mask). The mask pattern (singling mask) has a square area of 256 dots in the vertical direction×256 dots in the horizontal direction, and 65,536 dots are randomly and evenly (dispersedly) arranged in the area. The dots are arranged at the density the same as the resolution in drawing of the drawing mechanism 40. To each dot, one of numerical values of 0 to 255 is assigned, and every 256 dots have the same numerical value and are randomly and evenly arranged in the area. To the actual drawing target surface, a plurality of mask patterns is applied to cover the entire drawing target surface. To the mask pattern, a threshold range to the numerical values assigned to the dots is set so as to extract dots in the threshold range, and of all the pixels constituting a design image, pixels corresponding to the extracted dots are set as the drawing pixels to be drawn by the drawing mechanism 40, and the other pixels are set as the non-drawing pixels not to be drawn by the drawing mechanism 40. More specifically, as shown in FIG. 6, if the threshold range is set to 0 to 12, the drawing pixel percentage is 5%; if the threshold range is set to 0 to 25, the drawing pixel percentage is 10%; if the threshold range is set to 0 to 38, the drawing pixel percentage is 15%; if the threshold range is set to 0 to 63, the drawing pixel percentage is 25%; and if the threshold range is set to 0 to 255, the drawing pixel percentage is equal to the drawing amount required for all the pixels P in its corresponding line, namely, 100%. The above values of the threshold range are examples, and even if the threshold range is set to 64 to 127, 128 to 191, or 192 to 255, the drawing pixel percentage is 25%. If the threshold range differs, positions of the corresponding dots in the mask pattern also differ. In this mask pattern (singling mask), all the dots are randomly and evenly arranged, and hence regardless of whether the drawing pixel percentage is high or low as a result of the threshold range applied thereto to set the drawing pixels in each scan, the density is uniform as shown in FIG. 6.

As an ordinary drawing method, a table of the threshold range set for such a mask pattern is prepared, and on the basis of the table, in the $1^{st}$ pass ($1^{st}$ scan), the threshold range is set to 0 to 63, and drawing is performed with the drawing pixel percentage of 25%; in the $2^{nd}$ pass ($2^{nd}$ scan), the threshold range is set to 64 to 127, and drawing is performed with the drawing pixel percentage of 25%; in the $3^{rd}$ pass ($3^{rd}$ scan), the threshold range is set to 128 to 191, and drawing is performed with the drawing pixel percentage of 25%; and in the $4^{th}$ pass ($4^{th}$ scan), the threshold range is set to 192 to 255, and drawing is performed with the drawing pixel percentage of 25%.

On the other hand, in this embodiment, as shown in FIG. 8, at the time of L2R1 in the $1^{st}$ pass ($1^{st}$ scan), in the left correction region LE, the threshold range to the mask pattern is set to 0 to 127 and gradually changed to 0 to 63; in the non-correction region C, the threshold range is set to (kept at) 0 to 63; and in the right correction region RE, the threshold range is set to 0 to 63 and gradually changed to 0, and at each point of each region, the drawing pixel percentage corresponding to the threshold range is set, and the drawing mechanism 40 performs drawing with the drawing pixel percentage. At the time of R2L2 in the $2^{nd}$ pass ($2^{nd}$ scan), in the right correction region RE, the threshold range is set to 0 to 127 and gradually changed to 64 to 127; in the non-correction region C, the threshold range is set to (kept at) 64 to 127; and in the left correction region LE, the threshold range is set to 64 to 127 and gradually changed to 127, and at each point of each region, the drawing pixel percentage corresponding to the threshold range is set, and the drawing mechanism 40 performs drawing with the drawing pixel percentage. That is, the drawing pixels in the $1^{st}$ pass are different from the drawing pixels in the $2^{nd}$ pass. Further, at the time of L2R3 in the $3^{rd}$ pass ($3^{rd}$ scan), in the left correction region LE, the threshold range is set to 128 to 255 and gradually changed to 128 to 191; in the non-correction region C, the threshold range is set to (kept at) 128 to 191; and in the right correction region RE, the threshold range is set to 128 to 191 and gradually changed to 128, and at each point of each region, the drawing pixel percentage corresponding to the threshold range is set, and the drawing mechanism 40 performs drawing with the drawing pixel percentage. During R2L4 in the $4^{th}$ pass ($4^{th}$ scan), in the right correction region RE, the threshold range is set to 128 to 255 and gradually changed to 192 to 255; in the non-correction region C, the threshold range is set to (kept at) 192 to 255; and in the left correction region LE, the threshold range is set to 192 to 255 and gradually changed to 255, and at each point of each region, the drawing pixel percentage corresponding to the threshold range is set, and the drawing mechanism 40 performs drawing with the drawing pixel percentage. That is, the drawing pixels in the $3^{rd}$ pass and the $4^{th}$ pass are different from the drawing pixels in the $1^{st}$ pass and the $2^{nd}$ pass, and the drawing pixels in the $3^{rd}$ pass are different from the drawing pixels in the $4^{th}$ pass.

The display control section 815 controls and thereby causes the display device 26 to display various display screens. In this embodiment, the display control section 815 causes the display device 26 to display, for example, the design menu screen of nail designs, thumbnail images for design check, nail images obtained by photographing the target finger U1, and various instruction screens and operation screens. When the curved surface level of the surface of the nail T of the user is determined, the display control section 815 may cause the display device 26 to display the determined curved surface level to request the user to confirm. In this case, the curved surface level may be changed or finely adjusted by the user through the operation unit 25, the touchscreen or the like if the user judges that the curved surface level, which has been automatically selected by the apparatus, is not proper for his/her nail T.

Hereinafter, with reference to FIG. 9 to FIG. 11, a drawing method used by the nail printer 1 according to this embodiment is described.

FIG. 9 is a flowchart showing the overall flow of a nail printing process performed by the nail printer 1. To perform the nail printing process with the nail printer 1, the user first turns on the power switch to start the control device 80. In response to an instruction input from the drawing switch, before the drawing operation, the imaging control section 811 controls the imaging mechanism 50 to cause the imager 51 to capture an image of the target finger U1 while causing the illuminators 52 to illuminate the target finger U1. In this way, the imaging control section 811 obtains an image (nail image) of the nail T of the target finger U1 (Step S1). Next, the nail information detection section 812 detects, in the nail image, the nail information on the outline of the nail T, the position of the nail T in the height direction and so forth (Step S2). The nail information detection section 812 then obtains, from the nail information, the curved surface correction level indicating the curvature of the nail T in the width direction as the drawing target (Step S3).

When the nail information detection section 812 obtains the curved surface correction level of the nail T, the drawing data generation section 813 determines the correction area set for the curved surface correction level (Step S4). The drawing generation section 813 then generates the drawing data (image data for drawing) on the basis of, for example, the determined correction area set for the curved surface correction level, taking the nail information on the shape and so forth of the nail T into account (Step S5).

When the drawing data generation section 813 generates the drawing data, the drawing control section 814 controls the operation of the drawing head 41 on the basis of the generated drawing data, and starts the drawing process of the nail design on the nail T (Step S6).

Next, with reference to FIG. 10 and FIG. 11, the drawing process is described. When starting the drawing process, as shown in FIG. 10, the drawing control section 814 determines whether or not drawing is L2R1 in the $1^{st}$ pass ($1^{st}$ scan) (Step S11). When determining that the drawing is L2R1 (Step S11: YES), the drawing control section 814 controls the drawing mechanism 40 to perform the drawing process corresponding to L2R1 (Step S12). More specifically, the drawing process is performed by drawing together with correction, wherein the correction is that, in the left correction region LE, from the starting point (i.e. the left end) to the ending point, the drawing pixel percentage is gradually reduced from 50% to 25%; in the non-correction region C, the drawing pixel percentage is 25%; and in the right correction region RE, the drawing pixel percentage is gradually reduced from 25% to 0%.

The drawing process corresponding to L2R1 in the $1^{st}$ pass ($1^{st}$ scan) is described with reference to FIG. 11. To perform the drawing process corresponding to L2R1 in the $1^{st}$ pass ($1^{st}$ scan), as shown in FIG. 11, the drawing control section 814 determines whether or not the drawing position is the left correction region LE (Step S21). When determining that the drawing position is the left correction region LE (Step S21: YES), the drawing control section 814 performs control to perform drawing with the drawing pixel percentage for the left correction region LE (Step S22). More specifically, in the left correction region LE, from the starting point (i.e. the left end) to the ending point, drawing is performed while the drawing pixel percentage is gradually reduced from 50% to 25%.

On the other hand, when determining that the drawing position is not the left correction region LE (Step S21: NO), the drawing control section 814 determines whether or not the drawing position is the non-correction region C (Step S23). When determining that the drawing position is the non-correction region C (Step S23: YES), the drawing control section 814 performs control to perform drawing with the drawing pixel percentage for the non-correction region C (Step S24). More specifically, in the non-correction region C, drawing is performed with the drawing pixel percentage of 25%.

On the other hand, when determining that the drawing position is not the non-correction region C (Step S23: NO), the drawing control section 814 determines whether or not the drawing position is the right correction region RE (Step S25). When determining that the drawing position is the right correction region RE (Step S25: YES), the drawing control section 814 performs control to perform drawing with the drawing pixel percentage for the right correction region RE (Step S26). More specifically, in the right correction region RE, drawing is performed while the drawing pixel percentage is gradually reduced from 25% to 0%. Steps similar to these are taken when drawings of R2L2, L2R3 and R2L4 are performed.

Referring back to FIG. 10, when determining that the drawing is not L2R1 (Step S11: NO), the drawing control section 814 determines whether or not the drawing is R2L2 in the $2^{nd}$ pass ($2^{nd}$ scan) (Step S13). When determining that the drawing is R2L2 (Step S13: YES), the drawing control section 814 controls the drawing mechanism 40 to perform the drawing process corresponding to R2L2 (Step S14). More specifically, the drawing process is performed by drawing together with correction, wherein the correction is that, in the right correction region RE, from the starting point (i.e. the right end) to the ending point, the drawing pixel percentage is gradually reduced from 50% to 25%; in the non-correction region C, the drawing pixel percentage is 25%; and in the left correction region LE, the drawing pixel percentage is gradually reduced from 25% to 0%.

On the other hand, when determining that the drawing is not R2L2 (Step S13: NO), the drawing control section 814 determines whether or not the drawing is L2R3 in the $3^{rd}$ pass ($3^{rd}$ scan) (Step S15). When determining that the drawing is L2R3 (Step S15: YES), the drawing control section 814 controls the drawing mechanism 40 to perform the drawing process corresponding to L2R3 (Step S16). More specifically, as with L2R1 in the $1^{st}$ pass ($1^{st}$ scan), the drawing process is performed by drawing together with correction, wherein the correction is that, in the left correction region LE, from the starting point (i.e. the left end) to the ending point, the drawing pixel percentage is gradually reduced from 50% to 25%; in the non-correction region C, the drawing pixel percentage is 25%; and in the right correction region RE, the drawing pixel percentage is gradually reduced from 25% to 0%.

On the other hand, when determining that the drawing is not L2R3 (Step S15: NO), the drawing control section 814 determines that the drawing is R2L4 in the $4^{th}$ pass ($4^{th}$ scan), and controls the drawing mechanism 40 to perform the drawing process corresponding to R2L4 (Step S17). More specifically, as with R2L2 in the $2^{nd}$ pass ($2^{nd}$ scan), the drawing process is performed by drawing together with correction, wherein the correction is that, in the right correction region RE, from the starting point (i.e. the right end) to the ending point, the drawing pixel percentage is gradually reduced from 50% to 25%; in the non-correction region C, the drawing pixel percentage is 25%; and in the left correction region LE, the drawing pixel percentage is gradually reduced from 25% to 0%. When the drawing processes of L2R1 in the $1^{st}$ pass ($1^{st}$ scan) to R2L4 in the $4^{th}$ pass ($4^{th}$ scan) on the drawing target surface finish, the drawing control section 814 finishes the drawing process(es) shown in Step S6 in FIG. 9.

Referring back to FIG. 9, the drawing control section 814 determines whether or not all of the drawing processes on the nail T have finished (Step S7). When determining that all of the drawing processes on the nail T have finished (Step S7: YES), the drawing control section 814 finishes the nail printing process. On the other hand, when determining that not all of the drawing processes on the nail T have finished yet (i.e. the drawing head 41 has not finished four scans yet) (Step S7: NO), the drawing control section 814 returns to Step S6 to repeat the drawing process.

As described above, according to this embodiment, the nail printer 1 includes the drawing head 41 which performs drawing on the surface of the nail T as the drawing target surface while moving in a first direction and a second direction different from one another. If the drawing target surface (surface of the nail T) has a first region which is acclivitous in the first direction and declivitous in the second direction, the drawing head 41 draws at least a part of a plurality of first pixels constituting an image to be drawn on the first region while performing the first scan in which the drawing head 41 moves in the first direction and the second scan in which the drawing head 41 moves in the second direction. The control device 81 controls the ratio of the drawing amount of the drawing pixels to be drawn by the drawing head 41 during the first scan to the drawing amount required for the plurality of the first pixels, which constitutes the image to be drawn on the first region, to be higher than the ratio of the drawing amount of the drawing pixels to be drawn by the drawing head 41 during the second scan to the drawing amount required for the plurality of the first pixels. While an acclivity is being scanned, ink droplets land well, and hence even if the drawing amount (at least one of the drawing area, the number of the drawing pixels and the number of dots as ink marks deposited in the nail T by drawing) is increased, a high-definition image(s) can be drawn. On the other hand, while a declivity is being scanned, ink droplets may not land although ink is ejected from the drawing head 41, or even if ink droplets land, they tend to land at inaccurate positions. Reducing the drawing amount at a scene where ink droplets tend to land not well and increasing the drawing amount at a scene where ink droplets can land well can make a drawn image(s) excellently finished. Further, the drawing operation is controlled such that change in the amount of the drawing pixels during the scan in the direction to ascend a slope and change in the amount of the drawing pixels during the scan in the direction to descend the slope complement each other. Hence, on the part(s)/region(s) where the drawing amount is reduced during one scan to prevent ink droplets from landing at inaccurate positions, pixels can be drawn during another scan which is paired with the one scan. This prevents variation in density from occurring in a drawn image(s) as a whole when viewed in the width direction of the nail T, and can realize a high-definition drawn image(s).

Because change in the drawing amount during the first scan and change in the drawing amount during the second scan, which are two scans (e.g. in the moving direction R on the outward way and in the moving direction L on the homeward way) which form a pair among an even number of scans, complement one another, an image having no density unevenness can be formed by one or more reciprocations of the drawing head 41.

Further, in this embodiment, if the drawing target surface is the surface of a nail curved such that one end part and the other end part in the width direction are low in height, and the central part in the width direction is high in height, the drawing amount can be controlled. This can realize beautiful nail prints.

Further, in this embodiment, the degree of change in the drawing amount to be drawn by the drawing mechanism 40 can be controlled according to the curvature of the drawing target surface (e.g. the surface of the nail T). The curve of the nail T is various from person to person. Controlling the drawing amount taking the curvature into account, thereby performing the correction appropriately for any shape of the nail T, can realize high-definition nail designs.

Further, in the embodiment, the drawing amount to be drawn by the drawing mechanism 40 is changed linearly. This prevents streaks or the like from appearing at the points where the drawing amount is adjusted, and can realize beautifully finished nail prints.

Further, in the embodiment, the mask pattern(s) having dots to which numerical values are assigned and which are randomly arranged is provided, and the drawing amount to be drawn by the drawing mechanism 40 is controlled by setting a threshold range to the numerical values assigned to the dots of the mask pattern. This can arrange the drawing pixels evenly, and can realize drawn images having no density unevenness.

Although an embodiment of the present invention is described above, needless to say the present invention is not limited to the embodiment and can be modified in a variety of aspects without departing from the scope of the present invention.

For example, in the above embodiment, as shown in FIG. 5, during a scan ($1^{st}$ scan or $3^{rd}$ scan), in the left correction region LE, from the starting point (i.e. the left end) to the ending point, the drawing amount is linearly reduced from 50% to 25%, and in the right correction region RE, the drawing amount is linearly reduced from 25% to 0%. However, as far as all the pixels in the left correction region LE and the right correction region RE which correspond to one another are filled (drawn) during an even number of scans, how to set the drawing pixels in each region is not limited to the manner described in the above embodiment.

For example, as shown in FIG. 12A, it is possible that during a scan ($1^{st}$ scan), in the left correction region LE, the drawing pixel percentage is 50% in a predetermined area from the starting point (i.e. the left end), and in the right correction region RE, the drawing pixel percentage is 0% in its corresponding area. Alternatively, as shown in FIG. 12B, it is possible that during a scan ($1^{st}$ scan), in the entire left correction region LE, the drawing pixel percentage is 50%, and in its corresponding entire right correction region RE, the drawing pixel percentage is 0%, so that drawing is not performed in the declivitous part. At a point(s) where the drawing amount is not changed linearly, a streak(s) may appear in a border part at the point. However, depending on a design to be drawn or the like, streaks in such border parts may not bother the user. As far as densities on the both end parts and the central part of the drawing target surface are uniform, a drawn image(s) looks beautifully finished.

As far as the correction is performed such that changes in the amounts of the drawing pixels during scans complement one another in the correction region corresponding to the acclivitous part and the correction region corresponding to the declivitous part, for example, as shown in FIG. 12C, the amount of the drawing pixels may be changed linearly in whole from one end to the other end in the direction along the curved surface. In this case, no non-correction region C is provided. In this case in which the amount of the drawing pixels is changed linearly in whole, too, as far as the drawing pixels are balanced between scans (drawings) which form a pair, namely, changes in the amounts of the drawing pixels during the scans complement one another, a beautifully finished image(s) as a whole can be realized.

Further, in this embodiment, as shown in FIG. 5, the amount of the drawing pixels is changed linearly, but not limited thereto, and may be changed curvedly. In this case too, as far as changes in the amounts of the drawing pixels during scans (drawings) which form a pair are set such that curves complementing one another are drawn, a beautifully finished image(s) having no density unevenness can be realized.

Further, in the above embodiment, drawing on the drawing target surface is performed by four passes (scans), but the number of the passes for drawing on the drawing target surface is not limited to four. As far as at least one pair of scans during which changes in the drawing amounts complement one another is present, any even number of scans, namely, two, six or a larger even number, can be adopted.

Further, in the above embodiment, as shown in FIG. 7, the ink ejector 411 of the drawing head 41 is divided into four areas of Ar1 to Ar4, but not limited to such a configuration and may be divided into a larger number of areas.

Further, in the above embodiment, the mask pattern(s) (singling mask(s)) shown in FIG. 6 are used to sort the drawing pixels to be drawn from the non-drawing pixels not to be drawn during each scan, but the method for sorting the drawing pixels to be drawn from the non-drawing pixels not to be drawn during each scan is not limited thereto, and any method for performing printing while thinning out pixels to be drawn (nozzles corresponding thereto) can be used.

Further, in the above embodiment, image data on nail designs is stored in the storage 82 of the drawing apparatus, but may be obtained from an external apparatus via the Internet, for example. Further, the control unit which performs drawing control such as the correction may be provided as an external apparatus, and the drawing apparatus itself may only have the functional part(s) which performs the drawing process(es) in response to control signals from the external apparatus.

Further, in the above embodiment, the drawing head 41 employs an inkjet system, but, for example, both an inkjet drawing head and a drawing tool, such as a pen, may be provided and used for drawing.

Although one or more embodiments are described in the above, they are merely examples and not intended to limit the scope of the present invention. The above embodiment(s) can be carried out in various forms, and can be omitted, replaced and changed in various aspects without departing from the scope of the present invention. These embodiments and modifications are included in the scope and the gist of the present invention as well as in the scope of claims below and the scope of their equivalents.

The invention claimed is:

1. A drawing apparatus comprising:

a drawing head which performs drawing on a drawing target surface while moving in a first direction and a second direction different from one another; and a control device which controls operation of the drawing head, wherein:

in a case in which the drawing target surface has a first region which is acclivitous in the first direction and declivitous in the second direction, the drawing head draws a plurality of first pixels to be drawn on the first region while performing each of (i) a first scan in which the drawing head moves in the first direction and (ii) a second scan in which the drawing head moves in the second direction, and the control device controls a ratio of a drawing amount of a first scan drawing pixel to be drawn in a line of the first region by the drawing head during the first scan to a drawing amount required for a plurality of pixels in the line among the plurality of the first pixels to be higher than a ratio of a drawing amount of a second scan drawing pixel to be drawn in the line by the drawing head during the second scan to the drawing amount required for the plurality of the pixels in the line.

2. The drawing apparatus according to claim 1, wherein the control device:

gradually reduces the ratio of the drawing amount of the first scan drawing pixel to be drawn in each line of the first region during the first scan to the drawing amount required for all pixels in each line of the first region according to the movement of the drawing head from a starting point to an ending point in the first region in the first direction; and gradually reduces the ratio of the drawing amount of the second scan drawing pixel to be drawn in each line of the first region during the second scan to the drawing amount required for all the pixels in each line of the first region according to the movement of the drawing head from a starting point to an ending point in the first region in the second direction.

3. The drawing apparatus according to claim 1, wherein the control device:

linearly changes the ratio of the drawing amount of the first scan drawing pixel to be drawn by the drawing head during the first scan to the drawing amount required for the plurality of the first pixels according to a position of the drawing head; and linearly changes the ratio of the drawing amount of the second scan drawing pixel to be drawn by the drawing head during the second scan to the drawing amount required for the plurality of the first pixels according to the position of the drawing head.

4. The drawing apparatus according to claim 1, wherein:

in a case in which the drawing target surface has a second region which is declivitous in the first direction, the drawing head draws, among a plurality of second pixels to be drawn on the second region, a third scan drawing pixel during the first scan and a fourth scan drawing pixel during the second scan, and the control device:

(i) reduces the ratio of the drawing amount of the first scan drawing pixel to be drawn in each line of the first region during the first scan to the drawing amount required for all pixels in each line of the first region from a first value to a second value smaller than the first value according to the movement of the drawing head from a starting point to an ending point in the first region in the first direction, and (ii) reduces a ratio of a drawing amount of the third scan drawing pixel to be drawn in each line of the second region during the first scan to a drawing amount required for all pixels in each line of the second region from a third value to a fourth value smaller than the third value according to the movement of the drawing head from a starting point to an ending point in the second region in the first direction; or (i) reduces a ratio of a drawing amount of the fourth scan drawing pixel to be drawn in each line of the second region during the second scan to the drawing amount required for all the pixels in each line of the second region from a fifth value to a sixth value smaller than the fifth value according to the movement of the drawing head from a starting point to an ending point in the second region in the second direction, and (ii) reduces the ratio of the drawing amount of the second scan drawing pixel to be drawn in each line of the first region during the second scan to the drawing amount required for all the pixels in each line of the first region from a seventh value to an eighth value smaller than the seventh value according to the movement of the drawing head from a starting point to an ending point in the first region in the second direction.

5. The drawing apparatus according to claim 4, wherein the drawing target surface is curved such that a center part of the drawing target surface in the first direction is higher than both ends of the drawing target surface in the first direction, and the control device sets lengths of the first region and the second region in the first direction according to a degree of the curve of the drawing target surface.

6. The drawing apparatus according to claim 4, wherein the control device:

has data on a mask pattern including dots to which numerical values are assigned and which are randomly arranged; and sets a threshold range to the numerical values assigned to the dots of the mask pattern to extract a part of the dots, and sets, based on the extracted part of the dots, the plurality of the first pixels and the plurality of the second pixels to be drawn by the drawing head.

7. The drawing apparatus according to claim 1, wherein the drawing target surface is a surface of a nail of a finger or a surface of a nail of a toe, and the first direction is a direction along a width direction of the nail.

8. The drawing apparatus according to claim 1, wherein the drawing head performs the drawing on the drawing target surface by ejecting a droplet of ink with an inkjet system.

9. A drawing method for performing drawing on a drawing target, the drawing method comprising:

in a case in which a drawing target surface of the drawing target has a first region which is acclivitous in a first direction and declivitous in a second direction different from the first direction, controlling a ratio of a drawing amount of a first scan drawing pixel to be drawn in a line of the first region by a drawing head during a first scan to a drawing amount required for a plurality of pixels in the line among a plurality of first pixels to be drawn on the first region to be higher than a ratio of a drawing amount of a second scan drawing pixel to be drawn in the line by the drawing head during a second scan to the drawing amount required for the plurality of the pixels in the line, wherein the first scan and the second scan are performed by the drawing head moving in the first direction and the second direction, respectively.

10. The drawing method according to claim 9, comprising:

gradually reducing the ratio of the drawing amount of the first scan drawing pixel to be drawn in each line of the first region during the first scan to the drawing amount required for all pixels in each line of the first region according to the movement of the drawing head from a starting point to an ending point in the first region in the first direction; and gradually reducing the ratio of the drawing amount of the second scan drawing pixel to be drawn in each line of the first region during the second scan to the drawing amount required for all the pixels in each line of the first region according to the movement of the drawing head from a starting point to an ending point in the first region in the second direction.

11. The drawing method according to claim 9, wherein:

in a case in which the drawing target surface has a second region which is declivitous in the first direction, the drawing head draws, among a plurality of second pixels which is to be drawn on the second region, a third scan drawing pixel during the first scan and a fourth scan drawing pixel during the second scan, and the drawing method comprises:

(i) reducing the ratio of the drawing amount of the first scan drawing pixel to be drawn in each line of the first region during the first scan to the drawing amount required for all pixels in each line of the first region from a first value to a second value smaller than the first value according to the movement of the drawing head from a starting point to an ending point in the first region in the first direction, and (ii) reducing a ratio of a drawing amount of the third scan drawing pixel to be drawn in each line of the second region during the first scan to a drawing amount required for all pixels in each line of the second region from a third value to a fourth value smaller than the third value according to the movement of the drawing head from a starting point to an ending point in the second region in the first direction; or (i) reducing a ratio of a drawing amount of the fourth scan drawing pixel to be drawn in each line of the second region during the second scan to the drawing amount required for all the pixels in each line of the second region from a fifth value to a sixth value smaller than the fifth value according to the movement of the drawing head from a starting point to an ending point in the second region in the second direction, and (ii) reducing the ratio of the drawing amount of the second scan drawing pixel to be drawn in each line of the first region during the second scan to the drawing amount required for all the pixels in each line of the first region from a seventh value to an eighth value smaller than the seventh value according to the movement of the drawing head from a starting point to an ending point in the first region in the second direction.

* * * * *